US009822543B2

(12) United States Patent
Shalev et al.

(10) Patent No.: US 9,822,543 B2
(45) Date of Patent: Nov. 21, 2017

(54) METHOD AND SYSTEM FOR SHIELDING AGAINST NATURAL DISASTERS, TERROR ACTS AND WAR HAZARDS

(76) Inventors: Shaul Shalev, Savyon (IL); Yoram Sofrin, Reut (IL)

( * ) Notice: Subject to any disclaimer, the term of this patent is extended or adjusted under 35 U.S.C. 154(b) by 819 days.

(21) Appl. No.: 13/807,012

(22) PCT Filed: Jun. 27, 2011

(86) PCT No.: PCT/IB2011/052814

§ 371 (c)(1),
(2), (4) Date: Apr. 24, 2013

(87) PCT Pub. No.: WO2012/001610

PCT Pub. Date: Jan. 5, 2012

(65) Prior Publication Data

US 2013/0205691 A1 Aug. 15, 2013

Related U.S. Application Data

(60) Provisional application No. 61/358,955, filed on Jun. 28, 2010.

(51) Int. Cl.

| | |
|---|---|
| ***E04B 1/00*** | (2006.01) |
| ***E04H 9/12*** | (2006.01) |
| ***E04H 9/14*** | (2006.01) |
| ***E02D 29/00*** | (2006.01) |
| ***F28F 1/00*** | (2006.01) |

(52) U.S. Cl.

CPC ..... *E04H 9/12* (2013.01); *E02D 29/00* (2013.01); *E04H 9/14* (2013.01); *F28F 1/00* (2013.01)

(58) Field of Classification Search

CPC E04H 9/12; E04H 9/14; E04B 1/0007; E02D 29/00

USPC ..... 52/169.6, 169.1, 169.11, 220.1

See application file for complete search history.

(56) References Cited

U.S. PATENT DOCUMENTS

| | | | | |
|---|---|---|---|---|
| 3,138,124 | A * | 6/1964 | Baier | 109/1 S |
| 3,159,117 | A * | 12/1964 | Rosenfeld | 109/1 S |
| 4,128,204 | A | 12/1978 | Wade | |
| 4,631,872 | A | 12/1986 | Daroga | |
| 4,632,041 | A * | 12/1986 | Ohlson | 109/1 S |

(Continued)

FOREIGN PATENT DOCUMENTS

| | | | | |
|---|---|---|---|---|
| GB | 2075570 A | * | 11/1981 | E04H 9/04 |

*Primary Examiner* — Brian Mattei
(74) *Attorney, Agent, or Firm* — Mark M. Friedman

(57) ABSTRACT

It is provided an underground structure, usable at least as a shelter, having a light weight substantially cylindrical portion, of a cylindrical casing having a weight to area ratio in the range of 8 to 30 kg/m2. The casing has a strength level and an impermeability level high enough for serving as part a sealable underground liquid storage tank and at least one sealable opening connecting it to external spaces. The cylindrical portion includes openings for entering and exiting the interior of the portion, and passageways communicate the structure with outside spaces. The surrounding ground provides a geo-thermal reservoir which is used to regulate by a flowing fluid the temperature of the shelter space, modules inside the shelter or above ground structures. The structure includes provisions for receiving of variety of auxiliary systems like an air-treatment system, communication system water and power supply.

6 Claims, 9 Drawing Sheets

(56) References Cited

U.S. PATENT DOCUMENTS

| | | | | |
|---|---|---|---|---|
| 4,653,312 | A * | 3/1987 | Sharp | 588/259 |
| 4,805,360 | A * | 2/1989 | Kuehnl | 52/169.1 |
| 5,479,738 | A * | 1/1996 | Danna | 43/1 |
| 5,749,181 | A | 5/1998 | Bauman | |
| 6,385,920 | B1 | 5/2002 | Chandler | |
| 6,438,907 | B1 * | 8/2002 | McCarthy | 52/169.6 |
| 2006/0010830 | A1 | 1/2006 | Warren et al. | |
| 2011/0088339 | A1 * | 4/2011 | Mccarthy | 52/169.6 |

* cited by examiner

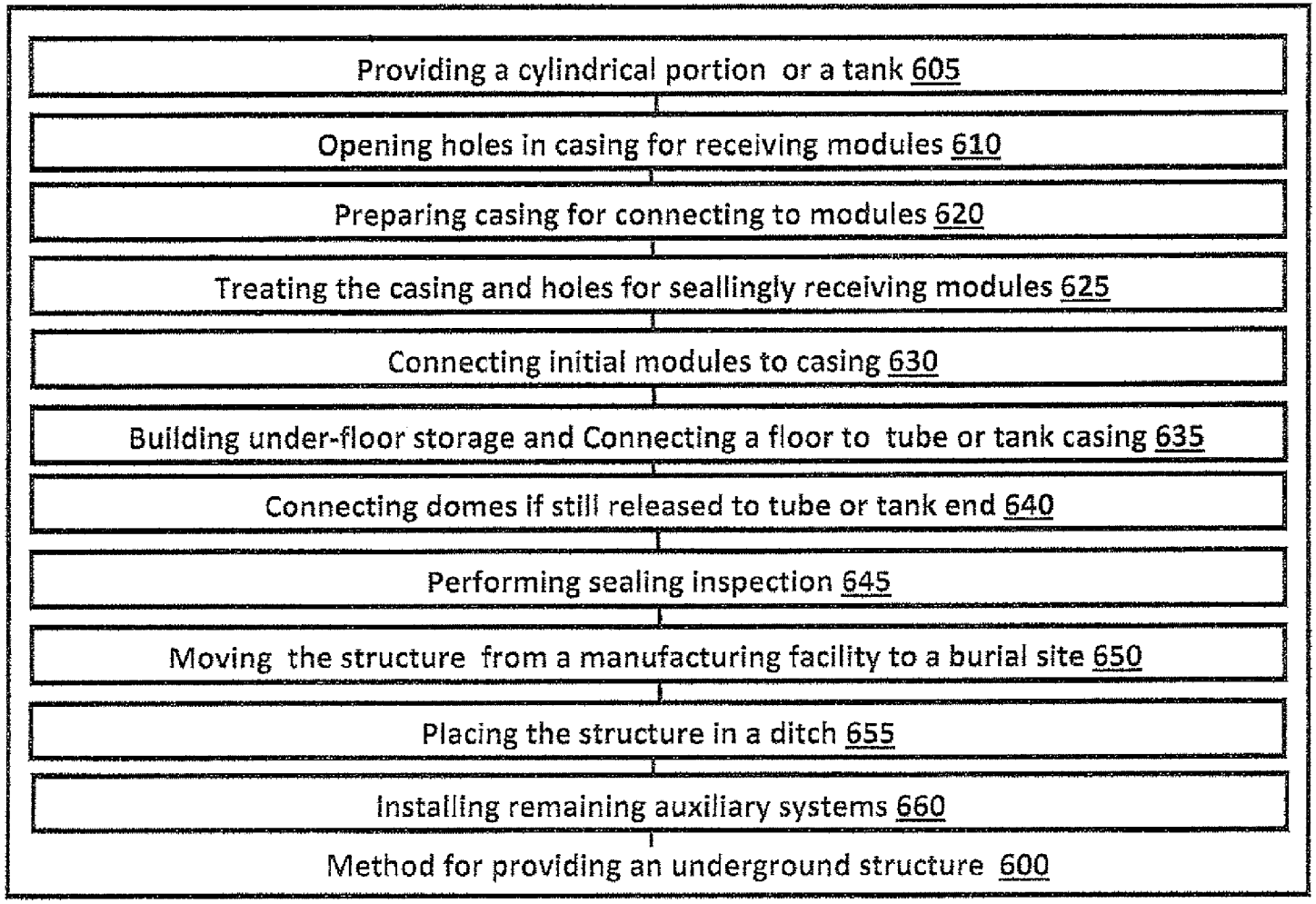
Fig. 6 part I (to be continued by Part II)

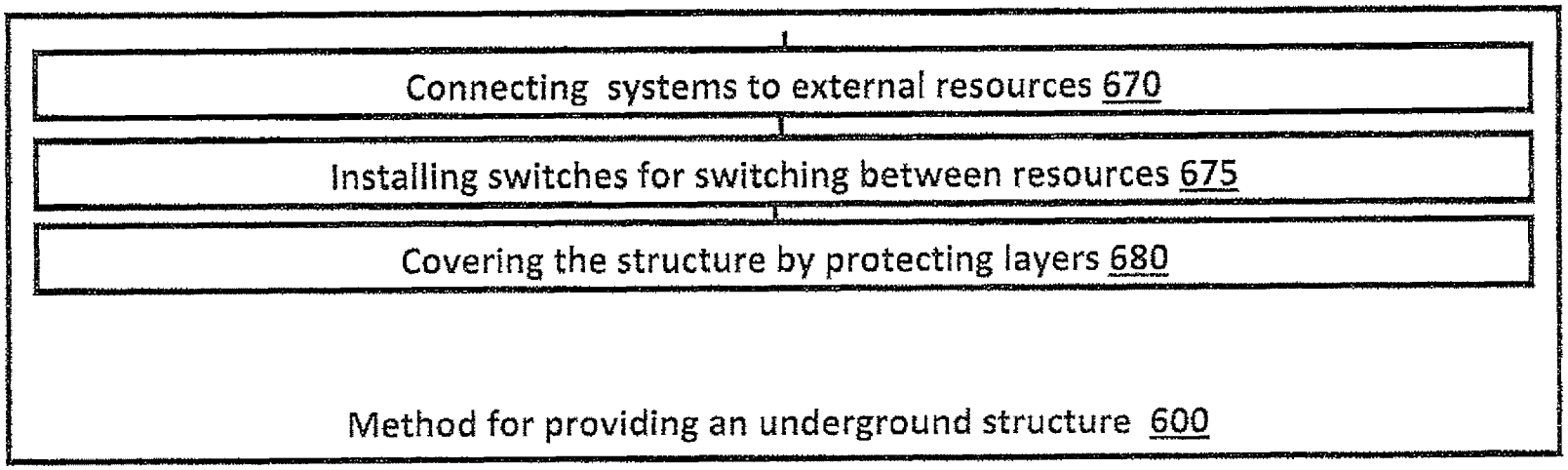
Fig. 6 Part II (continuation of part I)

METHOD AND SYSTEM FOR SHIELDING AGAINST NATURAL DISASTERS, TERROR ACTS AND WAR HAZARDS

BACKGROUND OF THE INVENTION

Field of the Invention

The invention is in the general field of shielding live creatures, and particularly human-beings, as well as protecting equipment and high value property against natural disasters, terror acts and war hazards. More specifically, the current invention proposes means and methods for providing high quality shielding against natural disasters, such as major storms Hurricane/Typhoon and Tornado, earthquakes, wild fires and flooding as well as shielding against man-made hazards such as terror and war acts including NBC (nuclear biological chemical) threats.

Description of Related Art

Shielding of civil population against natural disasters and man-made threats becomes a major design issue for both modern urban-life planners and individual families aiming at keeping high life quality and good property protection under a variety of hazardous circumstances. The most relevant threats are storms like the spring Tornadoes, summer Hurricanes and wild fires in North America, industrial accidents which include wide spread of hazardous materials, and typical man-made aggression acts up to NBC (nuclear, biological, chemical) war hazards.

It is an object of the current invention to provide modular, cost-effective systems and methods for on-site sheltering of a small group of people as well as property for a flexible period of few hours to few weeks. The small group of people as well as the protected property is thus independent of government services, local utilities and external supply just before, during and immediately after the disasters for which the sheltering is designed for.

BRIEF SUMMARY OF THE INVENTION

It is provided in accordance with some embodiments of the present invention, an underground structure configured for serving as a shelter. The structure has a substantially cylindrical portion which includes at least one sealable opening for communicating between the cylindrical portion and external spaces. The substantially cylindrical casing is preferably built of high strength light weight materials, characterized by weight to area ratio of the casing is in the range of 8 to 30 kg/m$^2$. In most cases the average specific weight of the casing material is smaller than 2.4, and the thickness of the 1 casing at more than 75% of its surface area is smaller than 19 mm, though a use of steel and concrete elements may be embedded in the design of the shelter's casing. The casing has a strength level and an impermeability level high enough for serving as part of an envelope of a sealable underground liquid storage tank. The cylindrical portion is configured to be placed underground in a horizontal position.

The majority of the casing may be made from fiberglass reinforced plastic, sometimes referred to as glass reinforced plastic, carbon composite, combination of metallic elements and composite material, or high density polyethylene.

In some embodiments, the structure may be dual-use, whereas the first use is a shelter and the second use may be an underground storage. Typically such storage facility may be designed to store items requiring substantially constant temperature range during storage time, and may also serve as an underground safe, a base for a geo-thermal temperature control system, mushroom grow room, an underground storage room for machines or a multi-use underground cellar.

In some embodiments, the cylindrical portion includes openings for entering and exiting the interior of the portion. Passageway, preferably of a substantially cylindrical symmetry, may communicate a part of the structure with outside spaces.

In some embodiments, the structure includes several cylindrical portions, having diameters which are preferably larger than 1.7 meter when used to protect human-beings but can have smaller diameters for the portions which are used to protect property. Passageways communicates the cylindrical portions to outside spaces.

In some embodiments, a flat floor extends along majority of a cylindrical portion.

In some embodiments, the structure includes containing means for thermally conducting material, a certain fluid for example, having thermal contact with a part of the cylindrical casing, which in turn has thermal contact with surrounding ground. Consequently, the surrounding ground provides a geo-thermal reservoir thermally communicating by a flowing fluid with parts of a structure. Preferably, a heat exchanger thermally associates the certain heat conducting material and the flowing fluid. Thus, the flowing fluid communicates the heat exchanger with parts of a structure, or equipment and associated other structures located internal or external to the structure.

In some embodiments, human or property motion into and out of a part of the structure is facilitated by passageway equipped with entry or exit means in accordance with the relative inclination of the passageway with respect to the part of the structure.

In some embodiments, human or property motion into and out of a part the structure is facilitated by a mechanized apparatus for mobilizing people or property into and out of the structure without requiring a substantial muscle efforts.

In some embodiments, the structure includes provisions for receiving of or actually includes, auxiliary systems like an air-filtering system, an air-condition system, a heating system, an air dehumidifier eliminating water from air and containing at least a major part of the water content for use in the structure, an oxygen-rich air supply, an air control system, a battery based electrical power supply, a utility based electrical power supply, an electricity generation system, an electricity control system, a dual use furniture system serving seating and sleeping capabilities, a kitchenette, a lavatory system, a water and sewage storage and management system, a garbage storage and management system, a local communication system with facilities outside the structure, a communication system with public communication networks, or a satellite link system.

In some embodiments, certain auxiliary systems are connectable to external facility, operated as part of an associated construction or as a public grid, and a switching system enables switching between options to provide a resource to the shelter.

In some embodiments, the structure includes multi-stage air-filtering system adapted for containing certain contaminants away from interior of shelter and shielding the shelter from the effect of such contaminants.

It is provided, in accordance with some embodiments of the present invention, a method for providing an underground structure configured for serving at least as a shelter. The method includes providing a substantially cylindrical portion, preparing the substantially cylindrical portion for connecting to modules for communicating with a space outside a part of the shelter, and providing a major part of the structure, which includes the cylindrical portion, for installing in a burial site.

The cylindrical portion diameter has an average preferable value larger than 1.7 meter when used for long term protection of human beings protect but may be based on smaller diameters when its main use is protecting property. The cylindrical casing is designed to be based on light weight materials characterized by typical weight to area ratio of the casing is in the range of 8 to 30 kg/m$^2$ and having in most cases, an average specific weight smaller than 2.4. The typical thickness of the casing at more than 75% of its surface area is smaller than 19 mm. The cylindrical casing has a strength level and an impermeability level appropriate for serving as part of an envelope of an underground liquid storage tank. The cylindrical casing is configured to be placed underground in a horizontal position.

In some embodiments the method includes a step of connecting to the cylindrical casing a flat floor extending along majority of the cylindrical portion.

In some embodiments the method includes a step of opening holes in the casing for interconnecting modules, and a step of connecting at least one module to the casing.

In some embodiments the method includes a step of performing sealing and sealing inspection of the major part of the construction. The sealing inspection is performed after connecting certain modules to the structure, sealing such connections, after connecting entry/exit doors to the structure, and before burial of the structure, or after burial of the structure in a ditch, before covering the structure by protection layers, or after covering the structure by protection layers.

In some embodiments, the method includes a step of moving a major part of the structure in an appropriate vehicle from a facility to the burial site. For that sake, the major part has to have the weight, strength, integrity and mobility such as to enable and withstand the moving on a standard truck.

In some embodiments, the method includes a step of placing a major part of the structure within the burial site in a single lift and place action. For that sake, the major part has to have weight, strength and integrity such as to enable and withstand the lift and place action.

In some embodiments the method includes a step of preparing the structure for receiving auxiliary systems.

In some embodiments the method includes a step of connecting systems to resources or supplies external to the underground structure. Preferably, the method includes a step of installing switches for switching between optional resources required for operating the structure and systems installed therein.

In some embodiments the method includes a step of covering the structure, after it has been placed in a burial site, by protecting layers which are designed in accordance with threats for which the structure is designed to act as a shelter.

It is provided, in accordance with some embodiments of the present invention, a geo-thermal interfacing complex for affecting temperature of a flowing fluid by a substantial ground mass. The complex includes a container configured for underground burial at certain depth while being human accessible from above ground through passageways installed on the container casing. The certain depth is in accordance with a required temperature of a geo-thermal reservoir based on surrounding ground. The complex also includes compartments disposed inside the underground container such as to leave internal container space for human accessing of interior of the compartment, and means for containing a heat conduction material, preferably certain fluid. The certain fluid resides in the compartment such as to be in thermal contact with ground surrounding the container. The complex includes a system for flowing a fluid, either the certain fluid if it is configured to flow, or for flowing a fluid in good thermal contact with the certain fluid, or through a heat exchanger. That flowing system includes a pipe set for thermally communicating the geo-thermal reservoir to spaces internal and external to the container. Note that the pipe set is directly maintainable by a worker after its underground deployment.

In some embodiments, the complex includes means for thermally isolating the compartment from associated spaces.

In some embodiments, the underground container is configured to include a space for, or is configured to be upgradeable to include a space for, facilities like an underground storage, and in particular a storage facility for items requiring substantially constant temperature range during storage time, a shelter for accommodating at least one person for at least two hour period, an upgradeable shelter for protecting against natural or man-made disasters, an underground safe, a mushroom grow room, an underground storage room for machines, and a multi-use underground cellar.

In some embodiments, the complex is integrated in an underground shelter, thereby serving temperature control needs of the shelter. Also, the complex is configured to provide a flowing fluid at a desired temperature range to at least one facility residing above ground. Preferably, a control system can select any subgroup of the facilities connected to a pipe set for receiving the flowing fluid at a desired temperature range.

BRIEF DESCRIPTION OF THE DRAWINGS

The subject matter regarded as the invention is particularly pointed out and distinctly claimed in the concluding portion of the specification. The invention, however, both as to system organization and method of operation, together with features and advantages thereof, may best be understood by reference to the following detailed description when read with the accompanied drawings in which:

FIG. 6 (part I and part II) is a flowchart of a method for providing an underground shelter.

DETAILED DESCRIPTION OF THE INVENTION

Figure 1A:
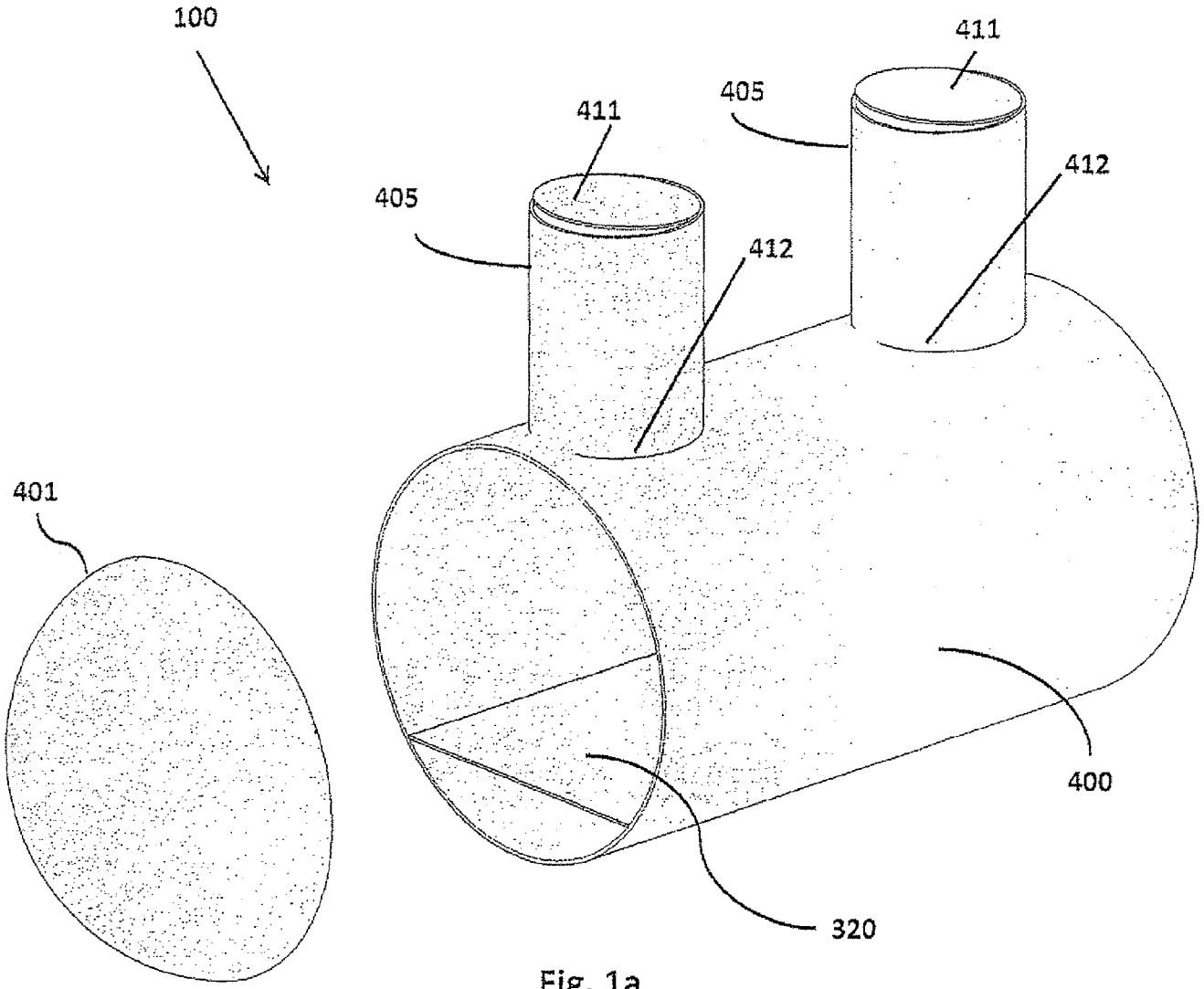
FIG. 1*a* illustrates an underground shelter made of a cylindrical portion and having two cylindrical passageways, a floor and two dome ends.

The present invention will now be described in terms of specific example embodiments. It is to be understood that the invention is not limited to the example embodiments disclosed. It should also be understood that not every feature of the methods and systems handling the described device is necessary to implement the invention as claimed in any particular one of the appended claims. Various elements and features of devices are described to fully enable the invention. It should also be understood that throughout this disclosure, where a method is shown or described, the steps of the method may be performed in any order or simultaneously, unless it is clear from the context that one step depends on another being performed first.

Before explaining several embodiments of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Unless otherwise defined, all technical and scientific terms used herein have the same meaning as commonly understood by one of ordinary skill in the art to which this invention belongs. The systems, methods, and examples provided herein are illustrative only and not intended to be limiting.

In the description and claims of the present application, each of the verbs "comprise", "include" and "have", and conjugates thereof, are used to indicate that the object or objects of the verb are not necessarily a complete listing of members, components, elements or parts of the subject or subjects of the verb.

Figure 1B:
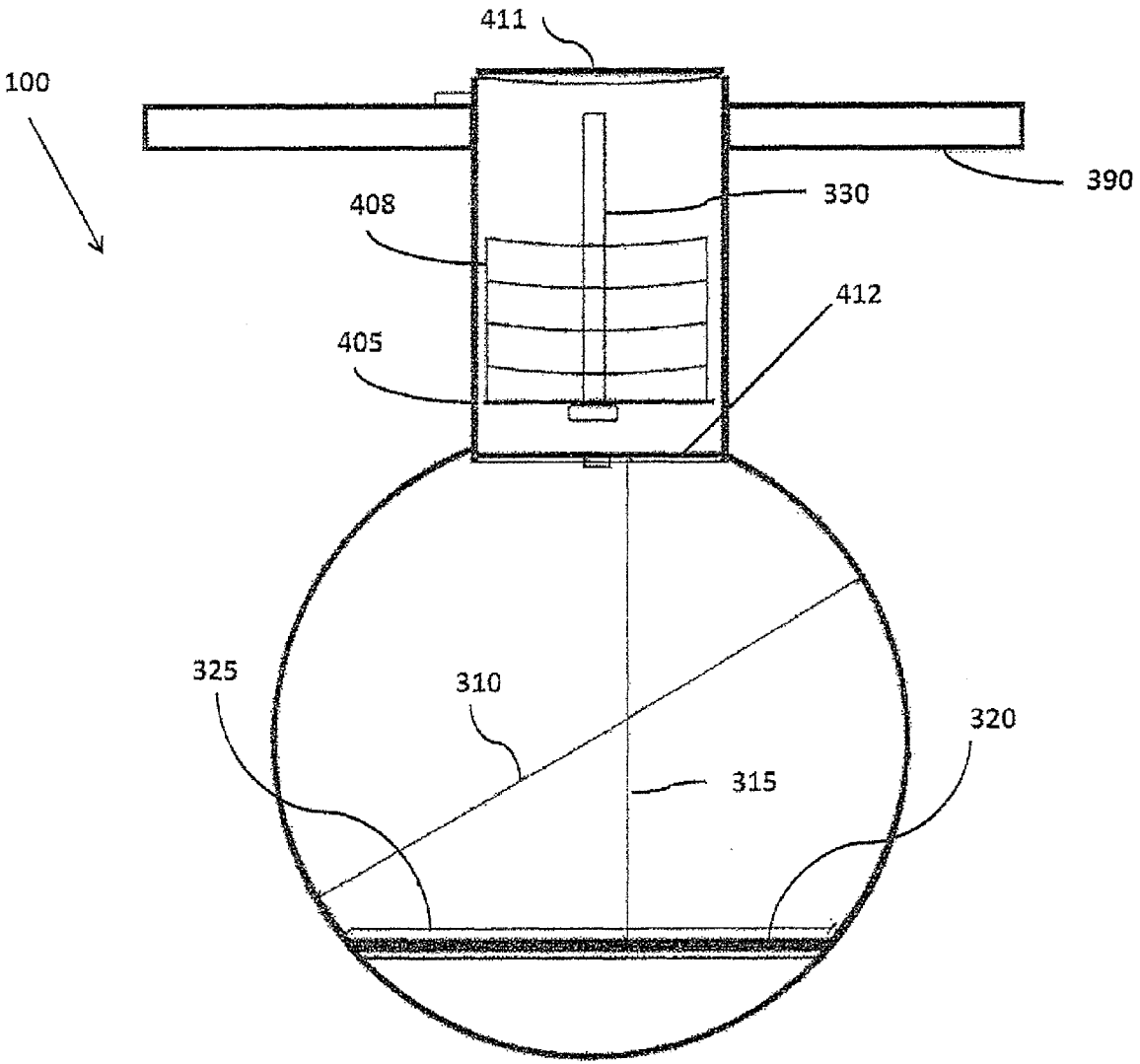
FIG. 1*b* presents a side view of the underground shelter.

The current invention provides a modular and cost-effective systems and methods for on-site sheltering of a group of people for a period between few hours to few weeks. FIGS. 1*a* and 1*b* illustrate an exemplary underground shelter 100, based on a principle mechanical design of a standard underground liquid storage tank, manufactured usually for storing fuels in a gas station, chemicals in a production facility or water for emergency needs or for water purification purposes. The basic shelter has a substantially cylindrical portion 400, ending with one or two domes 401 when the end of the cylindrical portion is not used for exiting or entering the shelter, and at least one passageway 405, preferably of a substantially cylindrical symmetry for communicating the shelter interior part with above ground space. Entering and exiting the passageway 405 is done through at the least one door 411 which may lead to second stage door 412 buffering between the passageway and the cylindrical portion of the shelter 400. Alternatively to basing the shelter on a storage tank design, the cylindrical portion 400 may be made from high diameter pipes used for transportation of gas, fuel, water or sewage.

The strength and seal ability of the proposed shelter is based, first, on the high strength and sealing specifications of storage tanks and high diameter pipes, which are designed for withstanding high pressure and shock values for years, under severe environmental conditions and very high reliability standards of immunity from any leakage to ground. Note that a solid structure based on a cylindrical symmetry is one of the best known simple bodies to withstand high-pressure and shock-waves both at and under ground level. Also, dome 401 may be a part of a sphere or an ellipsoid shape, both being geometrical bodies known for intrinsic strength.

Secondly, the shelter is buried underground, covered by soil, and by additional protecting layers. The protecting layers may include a combination of soil, paving aggregates, concrete, metallic sheaths of super heavy metals such as lead, and water reservoirs, either an open water reservoir or packed water reservoir.

The relatively low production cost of the shelter structure is a result of four design concepts. The first concept is using intermediate products of the of underground storage tanks and high diameter pipe industries as building blocks of the shelter. These industries are well developed and their products are inexpensive relative to home construction costs, and their products have excellent strength and impermeability specifications. The second concept is building the light weight shelter away from its deployment site, whereas deployment requires mainly digging the site for placing the shelter structure in it and integration of its modules into a system. Therefore, upgrading of an existing home to include the proposed shelter may be done fast and relatively cheaply. Alternatively, welding or interconnecting methods like pressed O-rings, as well as use of composite materials enable transporting of the light-weight cylindrical bodies to installation or deployment sites, and combining the parts into a single sealable and highly resistant structures on the deployment site.

The third cost-effective concept is employing part of the volume of the underground shelter as a dual-use underground structure, acting either as a shelter or as an underground storage of equipment, property, or operable supply sources to associated constructions or as a combination of all applications, for maximizing the value of the structure for its owners. The fourth concept is inclusion of the cover layers of the structure in the overall design of its protection means against the relevant disasters.

The shelter's building blocks, prior to its integration may be made of light weight composite materials, such as FRP, metallic materials, polymer materials, or high density coated concrete such as to provide sealable volumes, enabling minimal investment of energy for controlling isolation with regard to surrounding gases and liquids. The combination of built-in endurance of cylindrical bodies and a multi-layer cover enables tailoring the protection level of the shelter to a required level and for withstanding a specified threat. These threats include combinations of natural disasters as well as hazards of toxic materials or potential NBC-war (Nuclear/Biological/Chemical-war) events at the near vicinity of the shelter.

Typical protection levels which provides reasonable shielding against high-pressure and shock-waves can be achieved by either a composite material based construction having few mm average skin thickness, or a steel construction of about ½"-¾" skin thickness or alternatively by a reinforced concrete construction having at least 10-30 times thicker skin. At present, the best construction-weight/shielding performance is probably achieved by using modern materials of the FRP/GRP family. For achieving higher levels of protection such as when the relevant threat is man-made blasts which are expected to be triggered above or in a close vicinity of the structure, a well designed shallow multi-layer cover of the shelter enables the use of tubes or tanks made of light materials such as the FRP.

Thus, combining modern technologies of air and water conditioning and filtration together with the isolation of the shelter from nearby constructions, and employment of the multi-layer coverage of the shelter utilizing the surrounding ground as a heat-sink for stabilizing the ongoing temperature of the shelter skin, improves dramatically the requirements and the economy of investments required for sustaining living conditions in the isolated underground shelter.

The Shelter Structure

Figure 2:
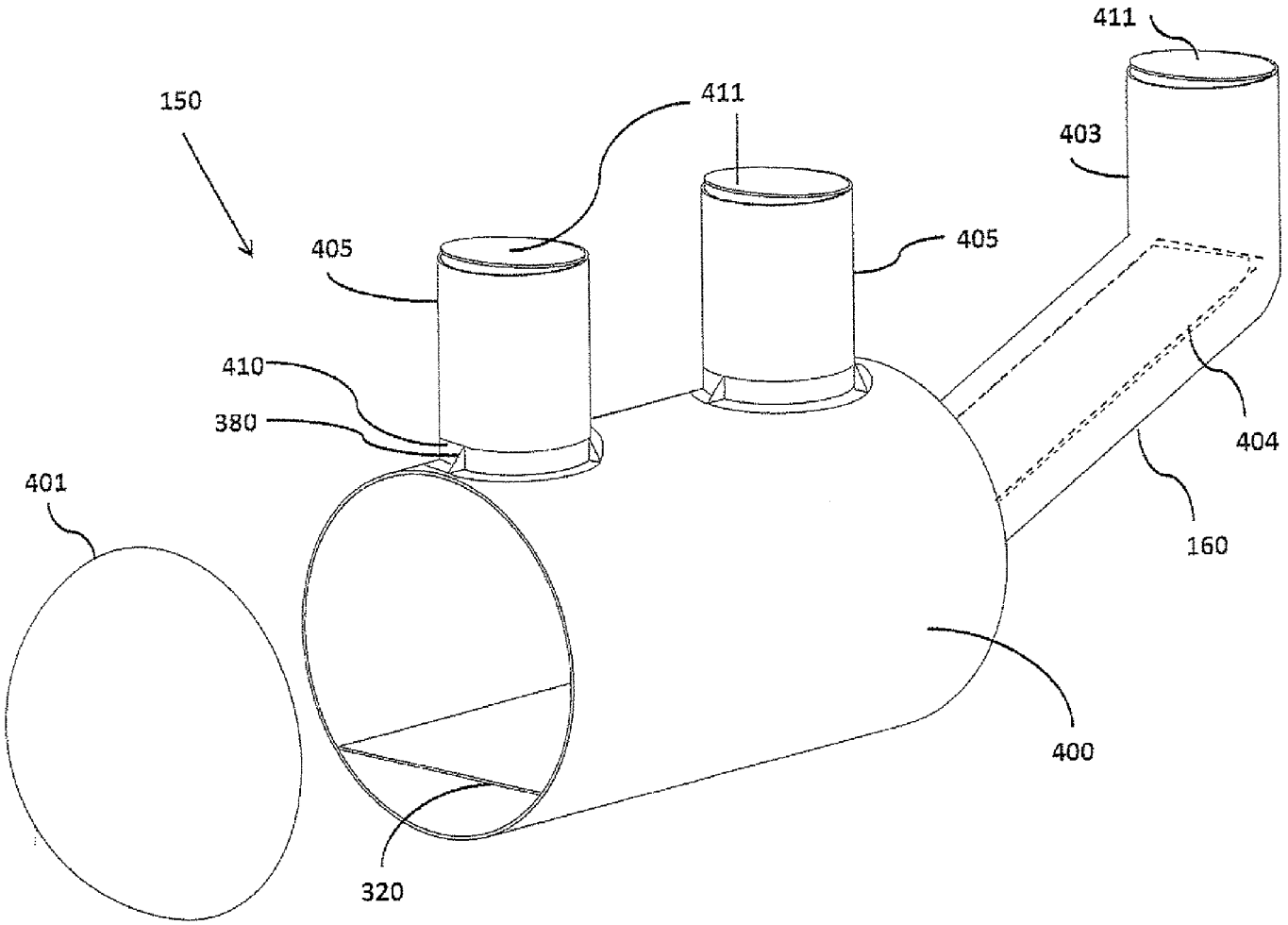
FIG. 2 illustrates an underground shelter having alternative declined and vertical passageways.

Referring now to FIGS. 1*a*, 1*b* and 2, the substantially cylindrical portion 400 has a light weight cylindrical casing having a low average specific weight and relatively thin average thickness of the cylindrical casing, allowing the entire construction to be easily transportable when integrated to its deployment site. Having weight to area ratio of the casing is in the range of 8 to 30 kg/m$^2$, preferably in the range of 10-26 kg/m$^2$, more preferably in the range of 12-18 kg/m$^2$ allows the casing total weight to range between few hundred kilograms to very few tons depending on the shelter's exact specs and dimensions. A steel or concrete casing, having typical weight to area ratios of 60-100 kg/m$^2$, or well above 100 kg/m$^2$, respectively, leads to total weight which is an order of magnitude heavier. Typical average specific weight of the cylinder skin is lower than 2.4 and its thickness at 75% of the surface area is smaller than 19 mm. The casing has a strength level and an impermeability level for serving as part of an envelope of a sealable underground liquid storage tank. Cylindrical portion 400 is configured to be placed underground in a horizontal position.

When the shelter is targeted for long stay of human beings, the average internal diameter 310 of cylindrical portion 400 is designed in most eases to be larger than 1.7 meter, preferably more than 2.0 meter, and most preferably, more than 2.5 meter. A flat floor 320 extends along cylindrical portion 400 and provides a living surface and a base for furniture. When accommodating human beings, the width 325 of the floor is in the range of 40% to 90% of the internal diameter 310, preferably in the range of 65-85% of the internal diameter 310, and most preferably 70-80% of 310. A maximal effective height 315 of the shelter between floor 320 and ceiling top is determined geometrically by floor width 325 and internal diameter 310. Preferably, height 315 is larger than 1.8 meter, for allowing convenient motion of an average adult, and most preferably, it is more than 2.1 meter, allowing long term comfortable stay of adults in the shelter.

Figures 3A, 3B:
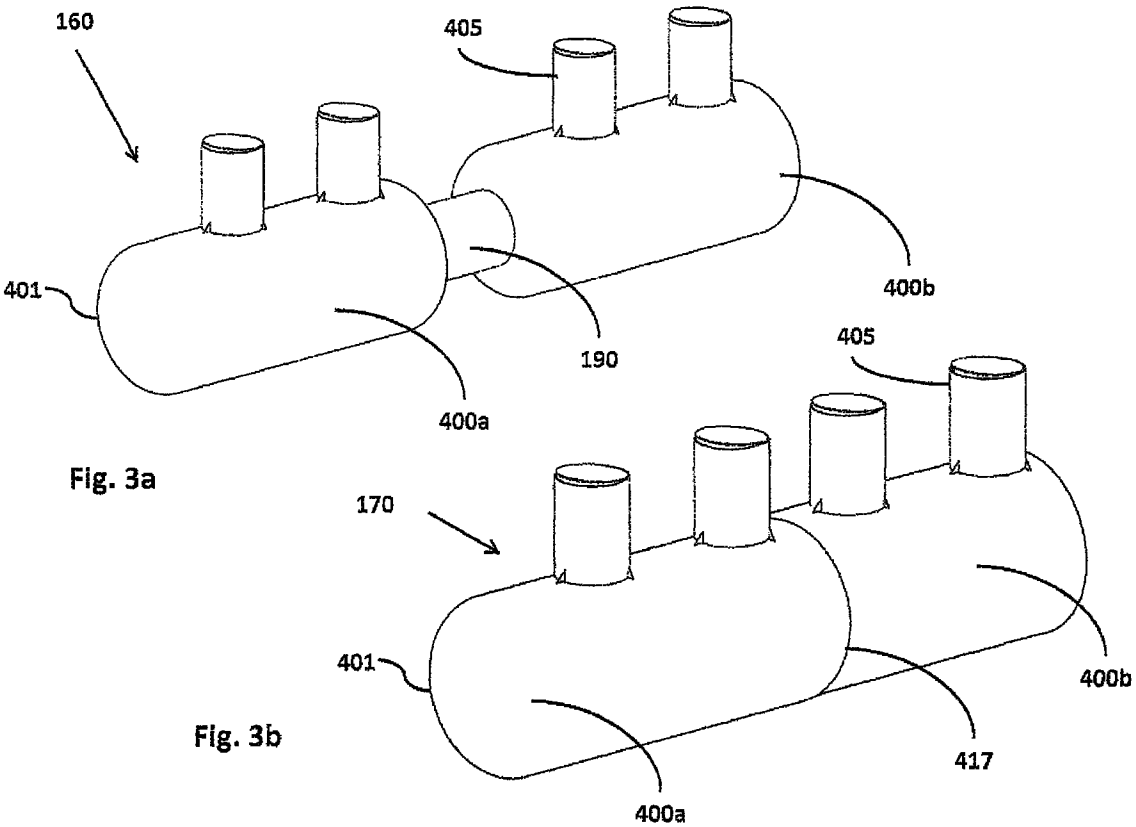
FIG. 3*a* shows two cylindrical portions communicating along a common axis by a cylindrical passageway.
FIG. 3*b* shows a cylindrical portion made of two storage tanks fused to each other.

The length of cylindrical portion 400 depends on expected number of users and the specified or expected sheltering period. FIG. 3*b* presents connection of two standard storage tanks to get a large affective length of the main cylindrical portion. Current production technologies, particularly the ones related to composite materials such as FRP, allow manufacturing of two or more segments of the cylindrical portion 400, with or without the domes, and connect them into a single sealed shelter, when the actual connection is producible practically at any location, including the final deployment site.

Floor 320 may be thick enough and made of suitable material such as to furnish the strength needed to serve as a floor and to thermally isolate or seal, when needed for storage purposes as elaborated below, the space below floor 320 from the space above it.

Human motion into and out of a part of the shelter is facilitated by a cylindrical passageway 405, equipped with sealable doors, such as 411, and entry or exit means. It is expected but not mandatory that a shelter includes at least two independent entry and exit passageways, like the two vertical passageways 405 of FIG. 1*a*, preferably having a cylindrical symmetry. Extra protective door 412 generates an isolated cell between door 412 and cover 411, to be used for extra-isolation of the inner space of the shelter while entering or exiting the shelter from or into a contaminated atmosphere Another option is described below with reference to FIG. 2.

Passageway 405 may be a standard man-holes or manways of an underground storage tank or a customized tube made for optimized inclusion of its content and the doors connected to it. In most cases it has a relatively narrow diameter, 40"-50" for example, and be linked to the main cylinder utilizing a preset opening. The simplest way of using such entry is using a retractable ladder (not shown), for example, a ladder having its fixed part linked to the relatively narrow diameter entry/exit passageway, while the moving part is drawn into the main cylinder. If needed, part of such a ladder may be drawn upward to an above ground level and retracted back into passageway 405 before closing external door 411 and when relevant, the internal door 412.

Note that the means for entering and exiting the shelter are in accordance with the relative inclination of the passageway with respect to the part of the structure it serves. For example, FIG. 1*b* shows a vertical passageway 405 having a mechanized apparatus for mobilizing one or two persons or relevant property into and out of the structure, and which can be integrated to the shelter either prior to or at any time post underground deployment. The apparatus is particularly useful for elderly and very young users who may find it complicated to use a vertical ladder, having a total height of several meters, particularly when hurrying up prior to an expected disaster. An optional set up for the mechanized apparatus includes a cage, a ramp or a chair like mechanism 408 driven to slide on a track 330 by a rotating motor (not shown), such as to save a substantial muscle effort. Alternatively, cage 408 may be also be driven by a piston and a telescopic rod 330 or manually when no relevant power is available.

The casing of cylindrical part 400 may be made from materials such as FRP/GRP (fiberglass/glass reinforced plastic), carbon composite, combination of metallic elements and composite material, high density polyethylene, or combinations of these materials. When the cylindrical portion 400 and the passageways 405 are based on material like FRP, the connecting passageway 405 to the body of cylindrical part 400 can be made by adhesion of polymer layers 410 to the external edge surfaces of passageway 405 with or without the need of rib like elements 380 for additional strength. Alternatively, the connection can be done utilizing a flange element made for example, of FRP or steel. Common gluing or welding technologies are employable as well and optimized upon defining the materials used for elements 400 and 405. Using such materials and well-known methods for their application is a relatively simple and inexpensive task which is producible even at the actual burial site of the structure.

In the example of FIG. 2, passageway 160 is inclined and is connectable to a cylindrical vertical part 403. A user may enter shelter 150 through door 411, by sliding over an appropriate sloping surface 404. Alternatively, a moderate staircase 404 is used for conveniently entering and exiting the shelter. In addition, a mechanized diagonal apparatus may be also installed. For installing passageway 160, one of the cylindrical portion 400 ends is left partially open, rather than closing it with a sealed dome cover 401.

While this solution presents a conventional approach to the main volume, it is also relatively expensive to assemble and requires more overall deployment space. Furthermore, the relatively long and diagonal passageway may also affect the overall resistance of the construction to in-ground shocks and pressure waves. On the other hand, the diagonal tube may be found to be a simpler solution for connecting the shelter with the indoor volume of a nearby construction. Note that in case the shelter is adjacent to the basement level of an existing construction, a horizontal passageway may connect the shelter to the basement, with appropriate vertical sealable doors at either one or both ends of the passageway.

Structures such as 100, 150, and the other alternative cases presented in FIGS. 1-3, may be dual-use, whereas the first use is a shelter. The second use may be an underground storage for property, equipment, operable machines and liquids of different kinds including a storage of items requiring substantially constant temperature and humidity range while being stored, for example, wine, art pieces, and special documents. Other uses of the structures can be a base for a geo-thermal temperature control system, an underground safe, mushroom grow room, or a multi-use underground cellar.

Figure 3C:
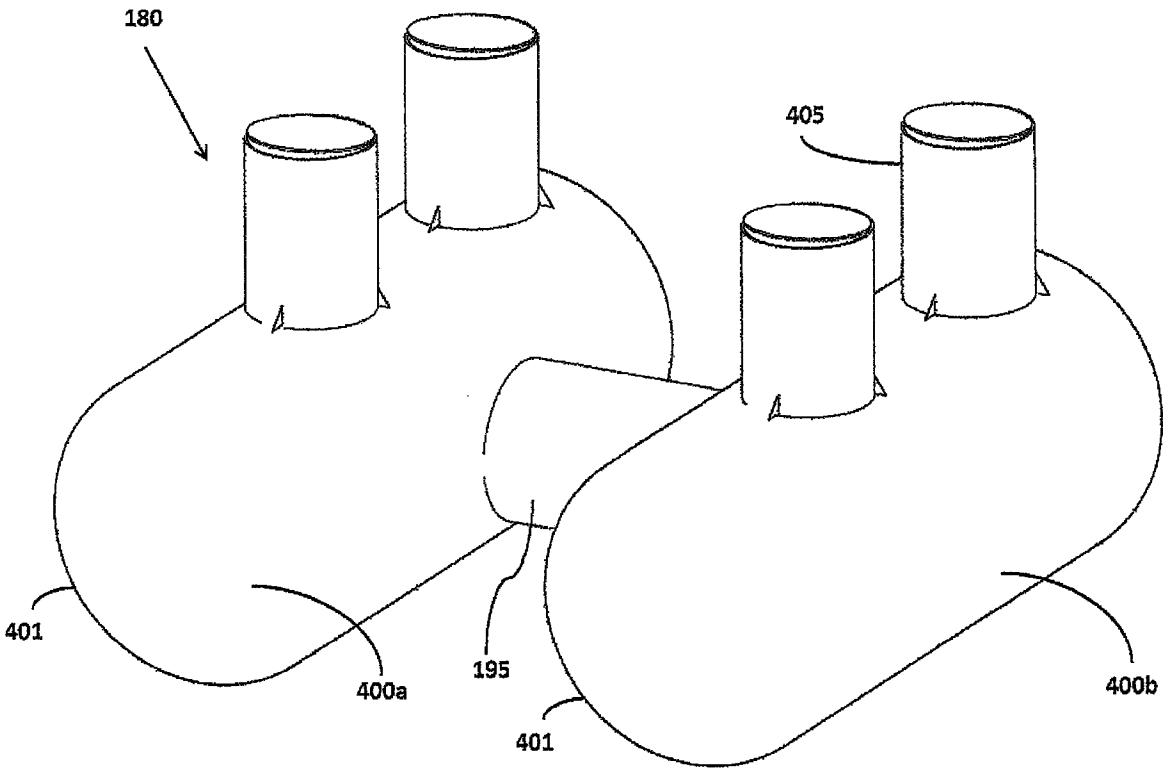
FIG. 3*c* shows two cylindrical portions residing side by side with an interconnecting passageway.

Referring now to FIGS. 3*a*, 3*b* and 3*c*, to accommodate more users or additional applications, respective structures 160, 170 and 180 includes cylindrical portions 400*a* and 400*b*. The cylindrical portions may have different diameters depending on their primary use. Vertical passageways 405 communicates portions 400*a* and 400*b* to outside spaces, while horizontal passageways 190 and 195 communicate 400*a* and 400*b*.

In FIG. 3*a* two storage tanks which include respective cylindrical portions 400*a* and 400*b* are connected longitudinally by a cylindrical passageway 190. Thus, users and articles may move from the left tank to the right tank and vice versa. The two sides of passageway 190 can be completely open or blocked by one or more doors located at its ends or at any intermediate point along its length. In FIG. 3*b*, two tanks of preferably the same diameter are provided with only two or three domes, whereas at least one of the domes at their interconnection plan is removed. Cylindrical segments 400*a* and 400*b* are linked together by a sealed connection 417, either in a production facility or on the burial site. The interconnection plan includes either no door, a door installed in one of the original domes, or a vertical wall, instead of the two domes which are removed, with a door. Thus, a larger space is obtained, allowing more facilities and convenient access.

Sealed connection 417, designed to withstand the loads, pressure and shocks waves as determined by the shelter specifications and conditions in the burial site, may be based, for example, on welding the segments, when the material permits such welding, or on gluing or flanging the cylindrical segments at either production or burial sites.

Depending on the shape of the area available for the shelter in the burial site, a side by side configuration illustrated in FIG. 3*c*, may be elected. Here, a horizontal passageway 195 joins sides of cylindrical portions 400*a* and 400*b*. Similarly, the two tanks may be arranged at different depth levels, one above the other, to some extent with a vertical or inclined connecting passageway in between (not shown).

Figure 4:
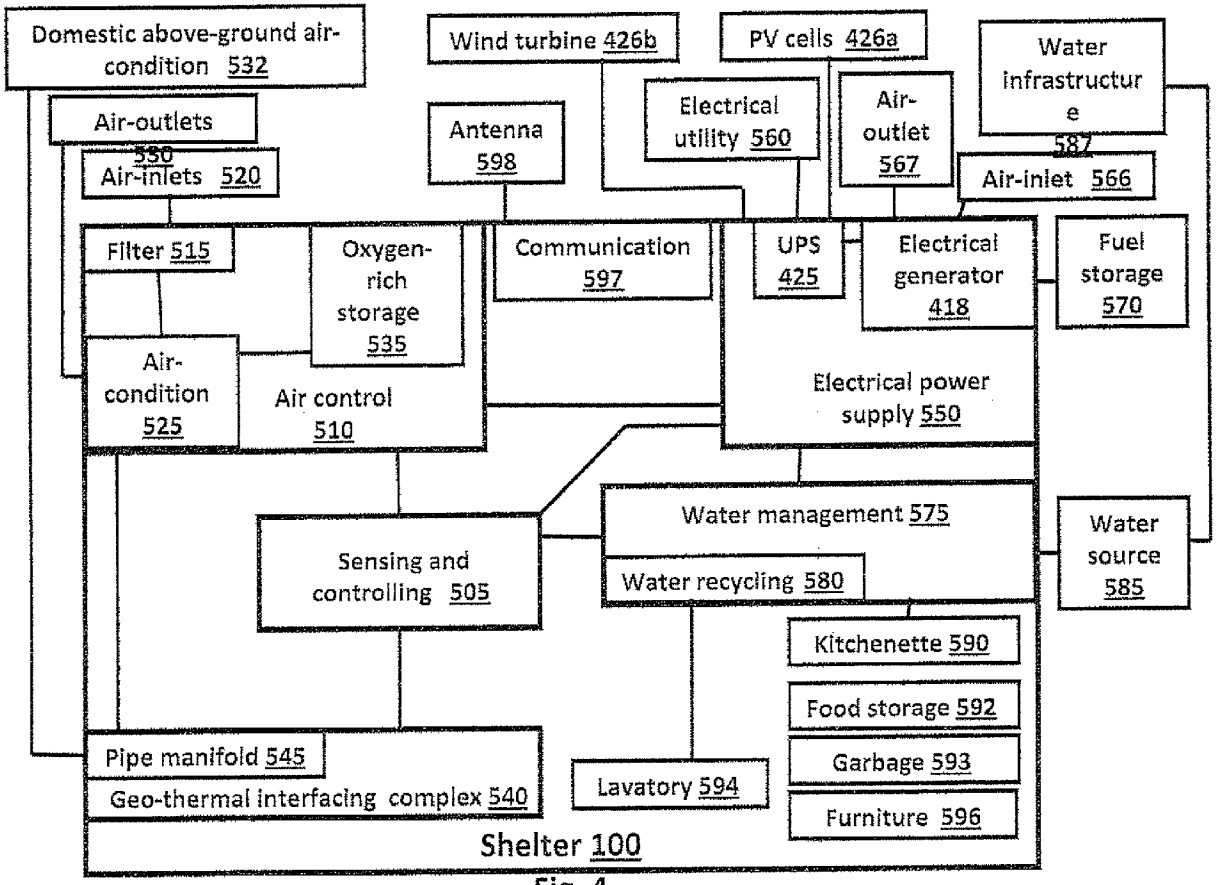
FIG. 4 is a block diagram of auxiliary systems of the underground shelter.

To facilitate comfortable long stay in the shelter, its structure includes provisions for receiving of, or actually includes, a variety of auxiliary systems as specified and ordered by a customer. Exemplary auxiliary systems are presented in the block diagram of FIG. 4 and in the exemplary physical layout of FIG. 5. The main systems are air-control and treatment system 510, geo-thermal interfacing complex 540, electrical power supply system 550, and water management system 575. A sensing and control system 505 has a variety of sensors spread in several locations inside and outside the shelter (not shown) controlling systems 510, 540, 550, and 575, it also may have a user interface (not shown) for programming and monitoring the systems or for switching part or all the controls between automatic and manual modes.

Most economical solutions for controlling air quality and temperature, as well as for operating generators utilizing fossil fuels, are based on sucking fresh air from above ground, and conducting it into the sheltered zone. Air control and treatment system 510 provides fresh air to the users and some of the facilities in the shelter. The most economical operating mode is based on sucking above ground air through 520 into the filtration system 515 and provisioning of clean fresh air through filtration system 515 to the sealed shelter, while using the air-conditioning system 525 as a closed system sucking filtered air from the shelter and controlling its temperature and humidity. The air pushed to the shelter through filtration system 515 intentionally generates a high pressure in the structure, which partially released through outlets 530.

Breathable air contamination at the shelter is avoided by placing the contaminated side of filtration system 515 within a sealed compartment, for example at a sealed cell at tank-ends, external to the main shelter's volume. Air-filter 515 is connected to the main volume by sealed airways conducting the filtered air to its users. Air filter 515 may be a multi-stage air-filtering system in which a first stage contains certain contaminants and thus keeps them away from interior of shelter and shields the shelter from their effect. Thus, coarse dirty particles and potentially radiating particles may be eliminated by a first preliminary filtration subsystem used in series and away from main filtration module of air filter 515. Also, a radiation blocking shield may be installed around air-filter 515 to shield main volume of the shelter from contaminants.

Air condition 525 may function as a heating system and an air dehumidifier which eliminates water content from air and contain it or deliver it to water management system 575. Alternatively, a dedicated dehumidifier is in use when the shelter temperature is controlled by geo-thermal modules as detailed below. Certain modules of air condition 525 may be located within dome 401, such as to use a space not available for human motion inside the shelter. Those spaces may be used to accommodate most of the auxiliary systems, and particularly the ones which should be placed in compartments which are sealed for achieving air and noise isolation from the rest of the shelter.

Accordingly, power generators, main engines or heat-exchange modules of the air conditioning/filtration which are connectable to the external atmosphere, or batteries of clean pressurized air or oxygen rich air, may be placed either, within a dedicated protective storage at or underground level, like fuel storage 570 and water tank 585, or within a sealable storage volume internal to the shelter, for example behind the sealed wall 409 at the dome ends, generating a sealed compartment isolated from the main living environment of the shelter by sealed doors, or under the shelter's floor 320. Such protected storage cells enable simpler acoustic and air isolation between their volume and the main space. In such a case, appropriate cables or pipes connect electric generator 418 and air-condition 525, respectively, to destinations at the shelter.

Sensing and control system 505 has sensors that sense changes of the environment external to the shelter, and activates manual or automatic operation of air-control system 510 for ensuring appropriate in-shelter air. For that sake, air control system 510 may include oxygen rich storage 535 for emergency period of no fresh air supply from air-inlet 520, due to flood, temporarily blocking the air-intake system, a threat of high concentration of non-filterable gases like CO in the above ground air or certain NBC threats. It should be noted that a CO blocking module is connectable as a serial add-on to all other modules of filter 515, such as to provide breathable air even in case of a fire.

To demonstrate air needs, here is an exemplary calculation. Assuming a need for Y cubic meters of fresh air at 1 atm pressure per each sheltered person per hour. Storage 535 of pressurized oxygen rich air of V $m^3$ at Z atm may be, used for controlled streaming of oxygen rich air to the shelter for a period of T/1, T/2, T/4, T/8 hours in cases of a sheltered group of 1, 2, 4, 8 persons, respectively, where T=ZV/Y. Y is strongly dependent on the way fresh air is streamed to its users. When such air is streamed into the open volume of the shelter, it is customary to use figures such as 16 or 6 cubic meters of atmospheric air per person per hour under "luxury" or emergency conditions, respectively. When air is streamed directly to the mouth/nose system of a user, it is customary to assume a requirement 0.5-1 cubic meter of atmospheric air per hour. Accordingly, assuming Z=192 atm, and, Y=16, 6 or 1 cubic meters, a reservoir V=0.5 of cubic meter, leads to a supply time T of 6, 16 or 96 hours, respectively for a single person. For four persons, the supply time T/4 is, 1.5, 4, 24 hours, respectively.

Alternatively, a use of a regulated mouse-piece enables a single person to use a standard diving tank independently of the above ground air for about 4 hours.

Sealed doors 411 disable undesired gas and water penetration into the sealed shelter. Sealed valves enable sealing each of the pipes leading liquid or gas into any of the shelter modules. When a complete sealing is required, for example when water column due to flooding covers the doors and snorkels 520,530,566 and 567, the shelter is planned to enable underwater stay based on Oxygen rich storage 535, as explained above. In areas known to be susceptible to flooding by, for example, Tsunamis and river flooding, snorkel 520,530,566 and 567 may be modularly expanded up to a height well above expected floods.

The 24 hours annual average of the underground temperature at depth of 3-6 meters is in the range of 12-22° C. in most inhabited regions of the world. Thus, to save electric supply, air condition 525 may receive cold water, in hot climate, or relatively warm water, at cold climate, from a geo-thermal interfacing complex 540. Complex 540 includes a compartment 546 defined for example by floor 320, domes 401, and casing bottom of cylindrical portion 400. The casing and domes 401 have thermal contact with surrounding ground. Compartment 546 may be divided to several chambers by walls 325, and may contain certain heat conducting material, preferably fluid, water for example, in thermal contact with the bottom part of the cylindrical casing and domes 401. Consequently, the surrounding ground provides a geo-thermal reservoir in thermal contact and thus thermal equilibrium with the fluid in compartment 546. Complex 540 can also include a "closed loop" pipe manifold 545 submerged in the fluid contained in compartment 546, containing a flowing fluid, which serves as a heat exchange between the water in compartment 546 and the flowing fluid circulated, preferably utilizing circulation pump system 547. Alternatively, when the reservoir at 546 contains sufficient fluid volume, such fluid can directly be used for communicating the surrounding ground temperature to either the air-conditioning modules such 525 or to any module at the vicinity of the geothermal cooling/heating system which should be temperature controlled or temperature-stabilized utilizing the pipe-system 543 and preferably using circulation pump system 549. Thus, the flowing fluids communicate the geo-thermal reservoir of the ground surrounding the shelter with air-condition unit 525 or internal heat emitting modules such as the electricity generator 418, saving power for cooling or warming the shelter and its auxiliary systems.

Complex 540 may also be used, for providing flowing fluid at a desired temperature to an air-condition unit 532 in an aboveground space. Such a supply can be conducted either directly from the fluid in reservoir 546 through pipelines 543 and circulation pumps 549 or by utilizing the heat exchanger and the pipe manifold 545 and the circulation pumps 547. Such application enhances the economic motivation to install the whole shelter, as it may save on-going energy costs of its owners independently of the usability of the structure as a shelter.

Electrical power supply system 550 provides electricity for lighting, air-filtration and conditioning and other auxiliary systems. In the exemplary design of FIG. 4, a UPS (uninterrupted power supply) unit 425 has an internal battery bank of high total energy and is connected to an external electric utility supply 560, presumably that of adjacent house, and to an electrical generator 418 installed in a protected space, preferably, due to maintenance reasoning, internal to the shelter structure.

A regular switch in UPS unit 425 ensures reception of electric power from utility 560, if available. Once utility 560 stops electrical supply, UPS 425 switches to its internal battery bank, monitoring the available electrical energy stored in the battery bank. Electrical generator 418 is turned on before substantial decrease of the available battery energy occurs, providing electrical power to current needs and increasing electrical energy in the battery bank. Generator 418 gets fuel from a storage 570 outside or inside the shelter through an appropriate pipe, and gets fresh air from air-inlet 566. Combustion gases are emitted through air outlet 567. Thus, even in case generator 418 is enclosed within the shelter, it is sealed off the air system used by the users.

A modular system for generating electricity independent of fossil source non-fossil fuel based, such as foldable PV solar panels 426*a*, or wind turbine 426*b* may be stored within the shelter and be used after disaster, when the above ground conditions allow limited opening of main doors 411.

Automatic switching by control system 505, backed by a manual switching system, can be used to switch supply to independent sheltered supply sources when above ground sources are discontinued for any reason.

Water management 575 is fed by a plurality of water sources 585 residing either outside or inside the shelter, while a plurality of mineral water bottles is stored inside the shelter for emergency. Part of the water sources 585 is kept under floor 320 in a special compartment, or as part of geo-thermal interfacing complex 540. When operating a dehumidifier in the shelter, water generated from the air-humidity is considered part of the water sources 585 of the shelter and is collected for either "white" (e.g. drinking) or "light-grey" (e.g. washing) uses. Water sources 585 are also connectable to a utility water infrastructure 587 and are refillable by fresh water whenever available. For saving water, a water recycling system 580 may be used. Recycled "grey" water from a variety of resources, is used in lavatory 594.

In cases of a relatively long stay in the shelter, a sealed water treatment system may be stored in the shelter for processing recycled "grey" water to be reusable as semi-"white" usable for any purpose beside drinking. The toilet "black" water is streamed to a sealed storage which is also used to store excess "grey" water when required. Thus, the shelter enables internal management of water during the entire period for which it is designed for, with no reliance on any external water source or sewage systems.

Preparing the shelter for its use period after being employed for relatively long time requires filling the "white" water reservoir and drainage the "grey" and "black" water storage tanks. Such filling and drainage activities can be conducted using pre-assigned sealable openings 432 or 433 on internal storage spaces, without requiring an installation of links to external water and sewage systems before deployment of the shelter. The shelter may optionally include valve infrastructure that enables online streaming of "white" water from water infrastructure 587 or drainage of "black" water storage into external sewage systems through a valve 435.

Additional auxiliary systems are a kitchenette 590, food storage 592 which uses side spaces and dome spaces, and garbage system 593.

The main living environment is designed to allow a comfortable relative long stay of a group in the protected shelter. The furniture system is modularly built to accommodate a given number of persons by supplying all necessary modules for comfortable stay when awake or asleep. As the shelter volume is limited, the modular design of the furniture systems is based on foldability and quick storage when not in use. Accordingly, beds are either folded into walls or under another furniture 428, or based on armchairs/sofas 596 which can turn into beds when required. By exploiting the fold ability and prompt storage/opening of the furniture items, the shelter may be easily designed to switch between a living environment, a bedroom, a dining room, or any alternative use assigned to the underground structure when it is not operating as a shelter. When the number of sheltered people exceeds the quantity for which the shelter is originally designed for, it can be switched to a relatively crowded seating room.

The shelter may have provisions for a communication systems 597 connected to above ground antennas 598 for public communication networks, or a satellite link system. Such provisions are based on a sealed pipe containing the relevant cables which are connectable to the components of the communication system internal to the shelter and to the relevant antennas or public cable-grid.

Methods for Providing the Shelter Structure

Before presenting a method for providing the shelter, its design methodology, production and deployment are separately described in detail. The design methodology is desired for enabling optimization of the proposed technologies in accordance with protection level requirements and specific deployment conditions. Note that the order of design steps is on the way of example only, and a different design order is possible. Also, the design may proceed in cycles, few cycles presumably, such as to achieve internal compatibility.

The methodology of the shelter design is based on the fact that the basic mechanical design of underground liquid storage tanks of all dimensions, together with a proper selection of the cover layers on top of the shelter, selection of the entry/exit door design and modular selection of the relevant auxiliary systems, enabling withstanding all potential threats for which the shelter may be designed for. Therefore, a potential owner of a shelter should define the target threats for which the sheltering is required, the number of maximal potential users of the shelter during a relevant disaster, the luxury level required during the longest possible stay, the required interface of the shelter with nearby constructions, and optionally select alternative day-to-day uses of the underground structure. In response the designer selects all relevant pre-designed modules for integration, including the main tank or tube defined by its length, diameter and material, the type and size of the leading passageways, and doors, the auxiliary systems building the ambient atmosphere underground and the deployment scheme including the burial depth and the cover layers of the underground structure.

Similarly to the design methodology, the production methodology is based on receiving the detailed design, and integrating a shelter structure which is preferably based on predesigned and in many cases pre-manufactured building blocks. The light-weight structure enables integration of the shelter at the production site and enables mobilization to deployment site by trucking. Main cylindrical portion of a single family shelter can be even towed to deployment site by a light truck. Furthermore, in case of shallow burial of the shelter and relatively short passageways leading to it, the entire shelter can be integrated at the production-site and transported by a truck to its deployment site. However, large diameter shelter, coupled to very long passageways will require final integration of the passageways at deployment site, due to possible trucking limitations.

Regarding deployment, there are three alternative modes of placing the main cylindrical portion of the shelter in its place. In ditch mode, usually the simplest mode, workers dig an open ditch and insert the structure into it from its top, with or without the leading passageway connected to the main cylinder. In tunnel mode, workers dig a tunnel and insert the main cylinder to its final place through an open side of the tunnel. In push mode, workers bring the cylinder to its place by inserting it to a tunnel external to its final position followed by pushing the cylinder to its final place. Once it reached final position, workers clean its internal volume and continue integration of the shelter.

After preparing the site for receiving the shelter structure, workers remove possible obstacles from shelter place, complete all infrastructure works for connecting the shelter to public networks or to local construction network, if required, like water, electric power, communication lines and sewage, complete installation of modules as required prior to insertion of main tank or open cylinder to the prepared ditch.

At this stage, workers insert the shelter structure to the ditch or tunnel, preferably, due to the light weight and ruggedness of the structure, by a single lift and place action, such that the axis of the main cylindrical portion modules is horizontal. Then per specific shelter model design, check full operability, seal ability and functionality of integrated modules and prepare site for covering the ditch by protection layers. Then, workers cover the shelter by protection layers, starting with bottom level and up to above ground levels, as designed per relevant threats.

In the commissioning stage, workers finalize installation of modules within shelters volume, connect shelter to power, water, communication and air-control systems and approve shelters infrastructure and lifesaving system, including power sources, water sources and air-quality control and conditioning systems. Workers also activate air control systems for ensuring that air quality and humidity is within specifications.

Based on the above detailed description of design, production and deployment, a method 600, presented in the flow chart of FIG. 6, may be used for providing an underground shelter structure. Note that the steps of method 600 may be performed in any order or simultaneously, unless it is clear from the context that one step depends on another being performed first.

Method 600 includes a step 605 of providing a cylindrical portion 400 as a tube or as a part of a pre-produced tank, a step 610 of opening holes in the casing for receiving modules for interconnecting modules 405 and 190, and 195, and all other holes required for connecting relevant sealable pipes to the casing, a step 620 of preparing casing for connecting modules internal or external to the tube or tank casing and particularly of preparing cylindrical portion 400 for connecting to passageways 405 and 190 communicating a part of the shelter with a space outside that part, a step 625 of treating the holes for sealingly receiving modules 405 and 190, 195 and all other relevant sealable pipes, a step 630 of connecting modules 405 and 190, 195 when relevant, to the casing of cylindrical portion 400. It also includes a step 635 of building the under-floor storage compartments, installing relevant piping systems and then installing the floor 320, and a step 640 of connecting remaining domes if are not part of a tank or partially removed from the tank for allowing other installations.

Method 600 also includes a step 645 of performing sealing inspection of the shelter structure 100 or 150. The sealing inspection is performed after connecting modules 405 and 190, 195 and all other relevant sealable pipes to the structure and sealing such connection and before burial of the structure, after installing doors 411 and when relevant doors 412, after burial of the structure in a ditch, before covering the structure by protection layers, or after covering the structure by protection layers 390.

Method 600 also includes a step of providing the shelter structure for installing in a burial site. That step includes a task 650 of moving the structure in an appropriate vehicle from a production facility to the burial site, and a task 655 of placing the structure within the burial site in a single lift and place action. To withstand these tasks the structure has to have appropriate strength, integrity and mobility.

The step 640 of final sealing of an end of the cylindrical portion by a dome 401 can be delayed to after placement of the shelter in its final position. Such a delay is typical to the cases in which exit/entry doors 412 are directly connected to the dome and the connection of such dome to the passageway 160 may be completed after placement.

Method 600 includes a step 660 of preparing the shelter structure for receiving auxiliary systems, as well as their actual installing, a step 670 of connecting systems to resources or supplies external to the underground structure. Method 600 may also include a step 675 of installing switches for automatic or manual switching between resources required for operating the structure and systems installed therein, as parts of the resources are external and parts are internal to the structure. Therefore, the switches facilitate utilization of resources external to the structure whenever possible without being fully dependent on such external resources. Finally, method 600 includes a step 680 of covering the structure after being placed in a burial site by protecting layers 390 in accordance with threats specified for the structure.

In the description of the shelter structure, a geo-thermal interfacing complex 540 has been described as an important auxiliary system, that may serve the shelter owner regular needs as a "by product" of its installation within the shelter. It is quite possible that the application of that such a system, for air-condition or heating, justifies its building mainly for that purpose, whereas the shelter becomes a potential "by product" of installing a geo-thermal system encapsulated in an underground storage tank having enough underground space for serving as a shelter-in-need. Such a shelter may not be included at all in the initial purchase of the geo-thermal air-conditioning system, but can be offered as a potential post-purchase upgrade of the purchased system. A significant advantage of complex 540 comparing to existing geo-thermal systems in which the pipe manifold is placed directly underground, is the long-term maintainability of the pipe system by enabling direct access to the pipes and inherent protection of the pipe system by the tank casing, against ground movements, shocks, impact by ground works and material degradation or corrosion related to exposure of pipes to underground materials.

Figure 5:
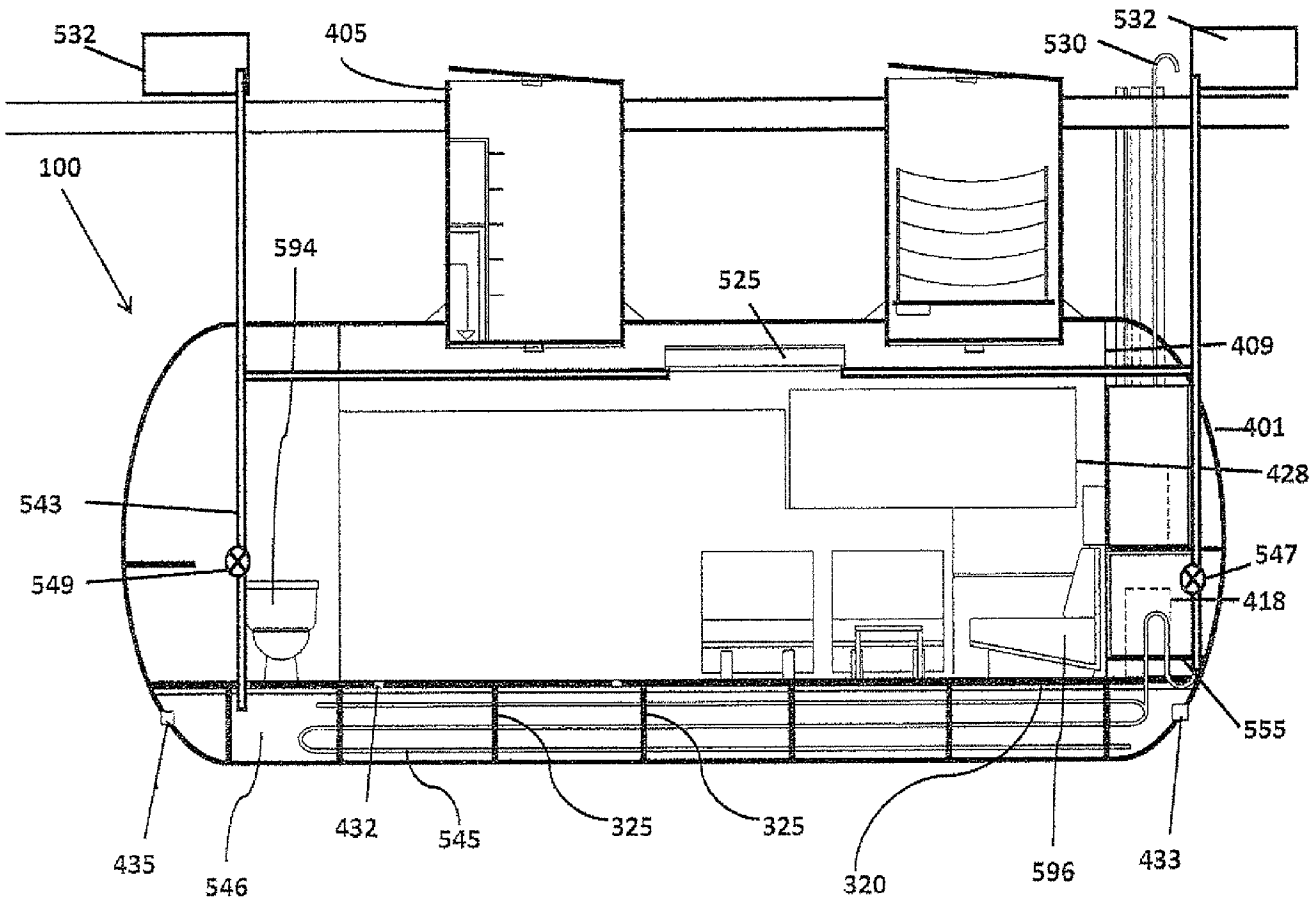
FIG. 5 presents a side view of an underground shelter with exemplary layout of certain auxiliary systems.

Thus, in the following, a geo-thermal interfacing complex 540 for affecting temperature of a flowing fluid by a substantial ground mass is described from a viewpoint of an independent system. FIG. 5 is used throughout this description. Complex 540 includes a cylindrical container 100 configured for underground burial at certain depth while being human accessible from above ground. The certain depth is in accordance with a required temperature of a geo-thermal reservoir based on surrounding ground. Complex 540 also includes a compartment disposed inside underground container 100 which can be defined for example by floor 320, bottom part of the casing of cylindrical portion 400 and domes 401, such as to leave internal container space for human accessing of interior of the compartment. It also includes a space 546 for containing a heat conducting material residing in the compartment, such as to be in thermal contact with ground surrounding the container, and a system for flowing a fluid. That system includes a closed-loop pipe set 545 filled with a second fluid, partially submerged in compartment 546, and optionally circulation pumps 547 for thermally communicating the geo-thermal reservoir to spaces internal and external to container 100, as illustrated in FIG. 5. In should be noted that when the heat conducting material at 546 is a fluid and the capacity of the fluid contained at compartment 546 is sufficiently high, such fluid can be directly used for circulation in the geothermal air-conditioning system utilizing pipe system 543 and optionally utilizing the circulation pump 549.

Note that pipe sets 545 or 543 are maintainable by a worker which enters container 100 through passageway 405, removes relevant covers and accesses the compartment interior. When required, floor 320 can be made of a material having isolation qualities such as to keep the temperature internal to the space 546 close to the temperature of the surrounding ground, even when the container 100 is opened for maintenance purposes or for any alternative purpose related to the dual use of the container.

Even though the main purpose of complex 540 is to provide cooling/heating fluid, its economic value may be enhanced by a second use. For that sake, underground container 100 includes a space for, or is configured to be upgradeable to include a space for, a variety of facilities. Exemplary facilities are an underground storage, and particularly a storage facility for items requiring substantially constant temperature range during storage time, wine for example. Other examples are a shelter for accommodating at least one person for at least two hour period, an underground safe, a mushroom grow room, and a multi-use underground cellar.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In particular, the present invention is not limited in any way by the examples described.

The invention claimed is:

1. A geo-thermal interfacing complex for affecting temperature of a flowing fluid by a substantial ground mass, the complex comprising:

(a) a container configured for underground burial at a certain depth while being human accessible through passageways, said certain depth being in accordance with a required temperature of a geo-thermal reservoir based on surrounding ground;

(b) at least one compartment disposed inside said underground container such as to leave internal container space for accessing an interior of the compartment;

(c) means for containing at least one thermally conducting material residing in said at least one compartment, such that said at least one thermally conducting material being in thermal contact with ground surrounding said container and serving as a geo-thermal reservoir;

(d) a flowing fluid being at least one of:

(i) said thermally conducting material being contained in said compartment and configured to flow directly from said compartment; and (ii) a flowing fluid in thermal contact with said thermally conducting material; and (e) a pipe set and at least one circulation pump for circulating said at least one flowing fluid.

2. The complex of claim 1 wherein the complex further includes means for thermally isolating said compartment from associated spaces.

3. The geo-thermal interfacing complex of claim 1 wherein said underground container is configured to include a space for, or is configured to be upgradeable to include a space for, at least one facility selected from the group of facilities consisting of:

(i) a storage facility for items requiring substantially constant temperature range during storage time;

(ii) a shelter for accommodating at least one person for at least one hour period;

(iii) an upgradeable shelter, enabling adding the necessary means for protecting at least one person against at least one natural or man-made threat for a period relevant for protection against said at least one threat, (iv) an underground safe;

(v) a mushroom grow room; and (vi) a multi-use underground cellar.

4. The complex of claim 1 wherein the complex is configured for being integrated in an underground shelter, thereby serving temperature control needs of the shelter.

5. The complex of claim 1 wherein the system includes a control system for selecting one or more facilities for receiving said at least one flowing fluid at a regulated temperature range.

6. The complex of claim 1 wherein a shape of the container is substantially cylindrical.

* * * * *